US005294108A

United States Patent [19]

Pollich et al.

[11] Patent Number: 5,294,108

[45] Date of Patent: Mar. 15, 1994

[54] SHEET FEEDER

[75] Inventors: Gerhard Pollich, Heidelberg; Ernst Czotscher, Neckargemünd, both of Fed. Rep. of Germany

[73] Assignee: Druckmaschinen AG Heidelberger, Heidelberg, Fed. Rep. of Germany

[21] Appl. No.: 939,063

[22] Filed: Sep. 2, 1992

[30] Foreign Application Priority Data

Sep. 2, 1991 [DE] Fed. Rep. of Germany ..... 4129132

[51] Int. Cl.[5] ..... B65H 1/30

[52] U.S. Cl. ..... 271/241; 271/159; 271/254

[58] Field of Search ..... 414/788.9, 900; 271/9, 271/145, 226, 241, 253, 254, 255, 158, 159

[56] References Cited

U.S. PATENT DOCUMENTS 3,951,401 4/1976 Marass ..... 271/158
4,245,830 1/1981 Fichte et al. .
4,697,804 10/1987 Pollich ..... 414/788.9
4,971,311 11/1990 Tsukimoto .

FOREIGN PATENT DOCUMENTS 0309388 3/1989 European Pat. Off. .
2808774 9/1978 Fed. Rep. of Germany .
2911735 10/1980 Fed. Rep. of Germany .

*Primary Examiner*—H. Grant Skaggs
*Attorney, Agent, or Firm*—Herbert L. Lerner; Laurence A. Greenberg

[57] ABSTRACT

A sheet feeder includes a first laterally adjustable guide for guiding a vertically displaceable pile table, a second laterally adjustable guide for guiding a vertically displaceable non-stop device, and a device for adjusting the first guide and the second guide in common and for adjusting the first and the second guides relative to one another in a given direction of movement for effecting a lateral alignment.

6 Claims, 4 Drawing Sheets

SHEET FEEDER

The invention relates to a sheet feeder, and, more particularly, to such a sheet feeder having guide means for a pile table and for a non-stop device.

Such a sheet feeder for sheet-fed printing presses, however, without a non-stop device, has become known heretofore from the European Published Patent Application A2 0 309 388. Guides are arranged so as to be laterally adjustable for the vertical movement of a pile table which is usually placed above a pile board. The pile board is suspended by chains which are operative via motor-driven, sensor-controlled adjustment elements, so that the pile table can be laterally aligned in accordance with an amount of lateral displacement of a sheet side edge detected by the sensor. A respective adjustment element is formed of a rotatable, motor-driven spindle which is mounted on the pile board and penetrates a threaded spindle nut fixed against axial displacement.

From the German Published, Non-Prosecuted Application (DE-OS) 28 08 774, a device has also become known for laterally aligning the main pile on a pile table in a sheet feeder.

In German Patent 29 11 735, there is described a device for automatic alignment of at least one side edge of the sheets in an auxiliary pile of a non-stop device formed of a rod which is supported by a transversely extending rail at the leading edge and at the trailing edge of the sheets, respectively. This device, too, includes a sensor which detects the position of the sheet side edge and through which the adjustment elements for laterally aligning the auxiliary pile are controlled. The adjustment elements are likewise formed of a threaded spindle threadedly penetrating a threaded spindle nut and which, in the device of this German patent, is driven by an electric motor. Heretofore known from this German patent is an arrangement of guides for the vertical movement of the auxiliary pile; however, these vertical guides are fixed in position. No mention is made in this German patent, however, that the main sheet pile can have separate means for automatic lateral alignment.

It is accordingly an object of the invention to provide a sheet feeder, especially for sheet-fed printing machines, of the foregoing general type which is constructed so that a successive feeding of the main pile and the auxiliary pile can be effected automatically by means of only one adjustment device and which enables a lateral adjustment of the main pile with respect to the auxiliary pile while the printing machine is in operation.

With the foregoing and other objects in view, there is provided, in accordance with the invention, a sheet feeder comprising first laterally adjustable guide means for guiding a vertically displaceable pile table, second laterally adjustable guide means for guiding a vertically displaceable non-stop device, and means for adjusting the first guide means and the second guide means in common and for adjusting the first and the second guide means relative to one another in a given direction of movement for effecting a lateral alignment.

By this construction according to the invention, automatic alignment and successive feeding of the main pile and the auxiliary pile in a non-stop device is effected by a single adjusting element, an additional lateral alignment of the main pile with respect to the auxiliary pile being possible while the printing machine is running.

This has the advantage that the auxiliary pile and a new main pile simultaneously fed into the feeder are laterally aligned automatically, such as by a sheet feed or travel control of the printing machine. Then, the new main pile can be adjusted so as to align its position to the position of the auxiliary pile, so that, with the change-over of the piles, a trouble-free transition from the auxiliary pile to the new main pile is afforded.

In accordance with another feature of the invention, the adjusting means comprise an adjusting element connecting the first and the second guide means and being operative in the given direction of movement.

In accordance with a further feature of the invention, the adjusting element includes a threaded spindle and a threaded spindle nut threadedly penetrated by the threaded spindle, the threaded spindle nut being fixed to one of the first and second guide means, and the threaded spindle being mounted on the other of the first and second guide means so as to be turnable thereon and fixed against axial movement relative thereto.

In accordance with an added feature of the invention, the adjusting means comprise another adjusting element operative in the given direction of movement for effecting a lateral alignment and adjustably connecting the second laterally adjustable guide means to a fixed side frame part, and including a drive motor for operating the other adjusting element, the first-mentioned adjusting element adjustably connecting the second guide means to the first laterally adjustable guide means.

In accordance with an additional feature of the invention, the other adjusting element comprises a threaded spindle mounted on the side frame part so as to be rotatable thereon and fixed against axial displacement relative thereto, and a threaded nut fixed to the second laterally adjustable guide means, the threaded spindle threadedly penetrating the threaded nut.

In accordance with a concomitant feature of the invention, the adjusting element connecting the first and the second guide means is manually rotatable.

It is thus believed to be apparent from the foregoing that the other adjusting element may be actuated either manually or by a motor in order to be able to vary the lateral distance between the one adjusting element and the other adjusting element.

Other features which are considered as characteristic for the invention are set forth in the appended claims.

Although the invention is illustrated and described herein as embodied in a sheet feeder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
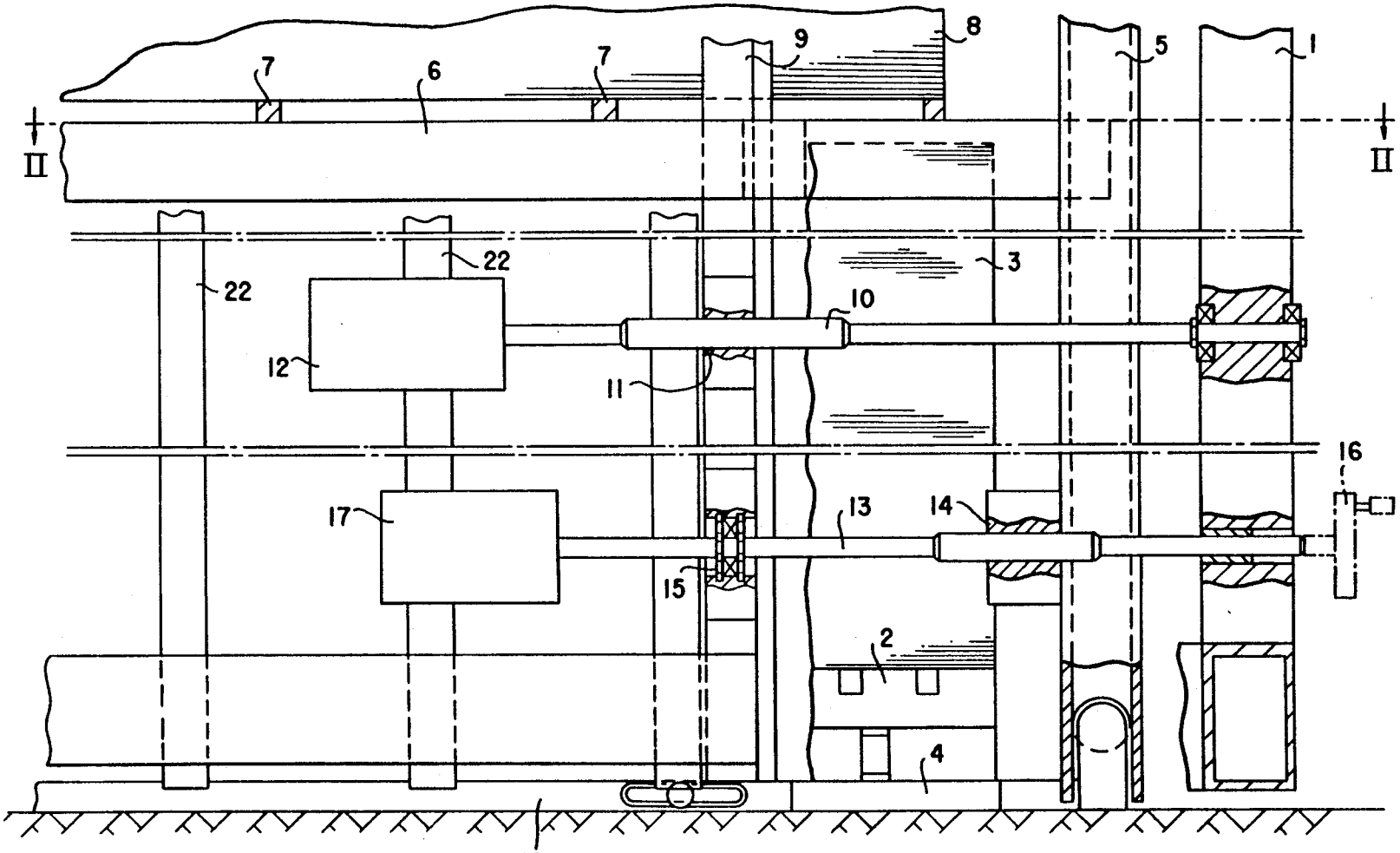
FIG. 1 is a fragmentary front elevational view of an embodiment of an adjustment device forming part of a sheet feeder, according to the invention, as seen in a direction counter to sheet transport direction through the sheet feeder.
Figure 2:
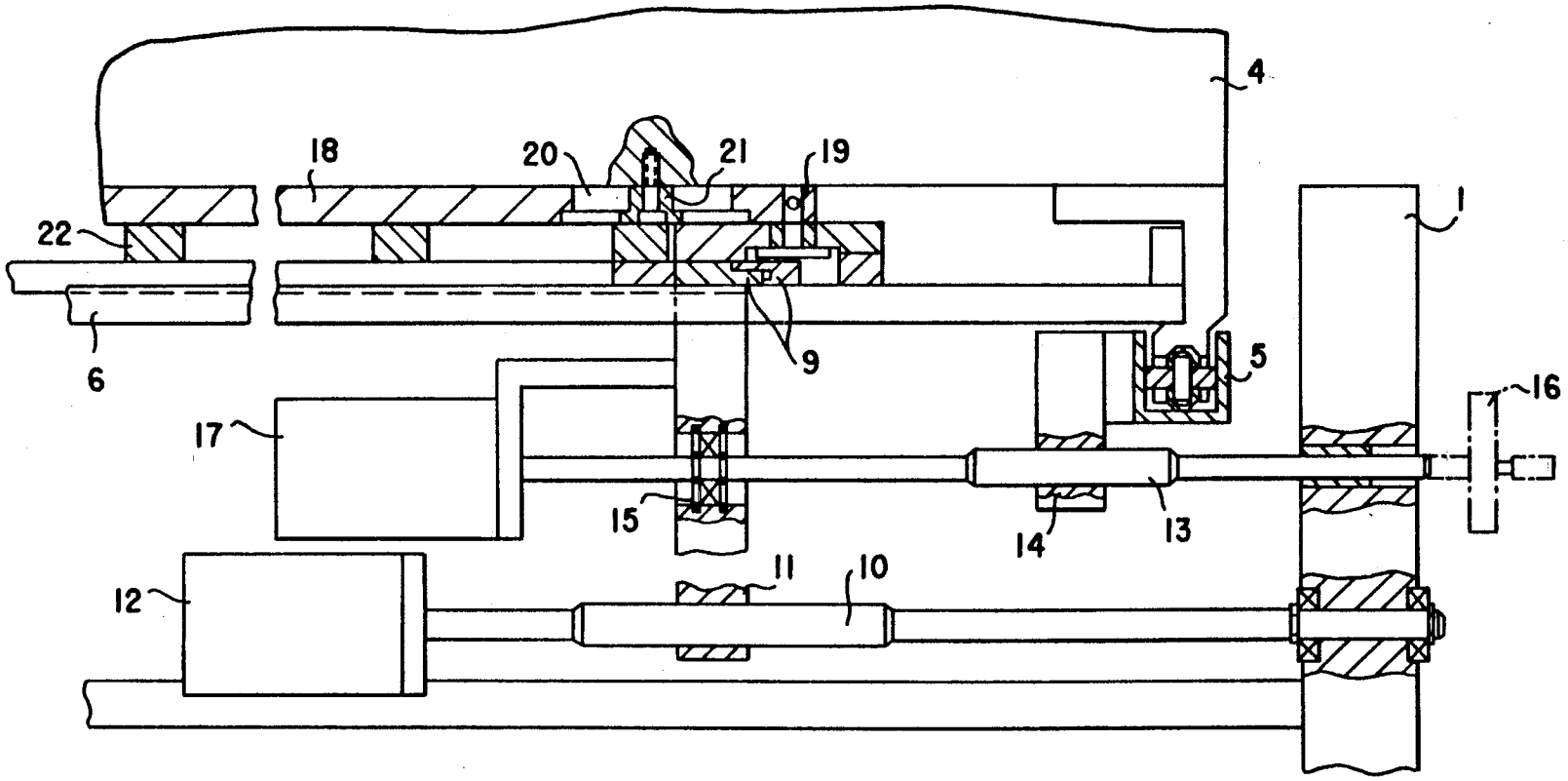
FIG. 2 is a horizontal sectional view of FIG. 1 taken along the line II—II in the direction of the arrows and showing the adjustment device below an auxiliary pile shown in FIG. 1.

Referring now to the drawings, it is noted that the embodiment illustrated in FIGS. 1 and 2, a sheet pile table for a main sheet pile 3 is arranged on a pile board 4 between two side frames 1 of a printing machine (only one of which is illustrated), the pile board 4, for example, being suspended by chains which are connected with a drive for performing the vertical movements of the pile board 4 and the pile table 2 arranged thereon. When moving vertically, the pile board 4 is guided in a guide 5 which is disposed so as to be movable laterally, in order to permit lateral alignment movements of the main pile 3.

A non-stop rail 6 at a front side of the sheet feeder and a non-illustrated non-stop rail at a rear side of the sheet feeder are arranged at likewise non-illustrated chain hoisting gear and serve as a support for non-stop rods 7 which are inserted from the rear side in sheet transport direction for supporting an auxiliary sheet pile 8 for the so-called non-stop or continuous operation. The non-stop rails 6 on both the front and the rear sides are guided in vertical guides 9 which are likewise arranged so as to be movable laterally. A threaded spindle 10 penetrates a threaded spindle nut 11 fastened to the guide 9, and has one end thereof fixed against axial displacement yet turnably mounted in a side wall of the machine frame 1. The threaded spindle 10 has another end which is connected with a geared motor 12 which is regulated by a non-illustrated sheet feeder travel control of the printing machine. Another threaded spindle 13 penetrates a threaded spindle nut 14 fastened to the vertical guides 5 for the pile table 2, and is mounted so as to be rotatable in a radial/axial bearing 15 located at the guide 9 yet not to be displaceable in axial direction. Thus, this threaded spindle 13 connects the vertical guide 5 for the pile table 2 with the vertical guide 9 for the front non-stop rail 6, so that the guides 9 and 5 are jointly laterally adjusted by the gear motor 12 which is regulated by the sheet travel control. The non-illustrated rear non-stop rail (auxiliary pile rail) is mounted so as to be readily displaceable laterally, and is entrained by the non-stop rods 7 and the pile resting thereon. It is also possible to provide a rigid connection between the two non-stop rails. Via the threaded spindle 13 which is turnable by a handwheel 16 and alternatively or additionally by a motor 17, a displacement of the vertical guide 5 for the pile table 2 with respect to the vertical guide 9 for the non-stop rail 6 can be effected, so that the main pile 3 can be aligned, on the one hand via, the non-illustrated sheet feed or travel control and, on the other hand, additionally by manual operation of the handwheel 16 or by operating the gear motor 17.

FIG. 2 illustrates an embodiment wherein the guide 9 is composed of several individual elements and can be operated in vertical direction as a guide for the pile board 4 as well as for the non-stop device not shown in FIG. 2. A transversely extending guide bar 18 is connected with the guide 9 by a guide pin 19 so as to be vertically displaceable thereon. A sliding part 21 fastened to the pile board 4 is horizontally displaceable in a slot-shaped notch or recess 20 formed in the guide bar 18 and engages behind a step formation or construction formed in the guide bar 18, so that a fixed connection in sheet transport direction is established between the guide 9 and the pile board 4. This connection is horizontally displaceable, however, by the sliding part 21 in the notch 20, and also vertically displaceable by the guide pin 19. Paper stops 22 extend vertically in parallel with one another, as shown in FIGS. 1 and 2.

Figure 3:
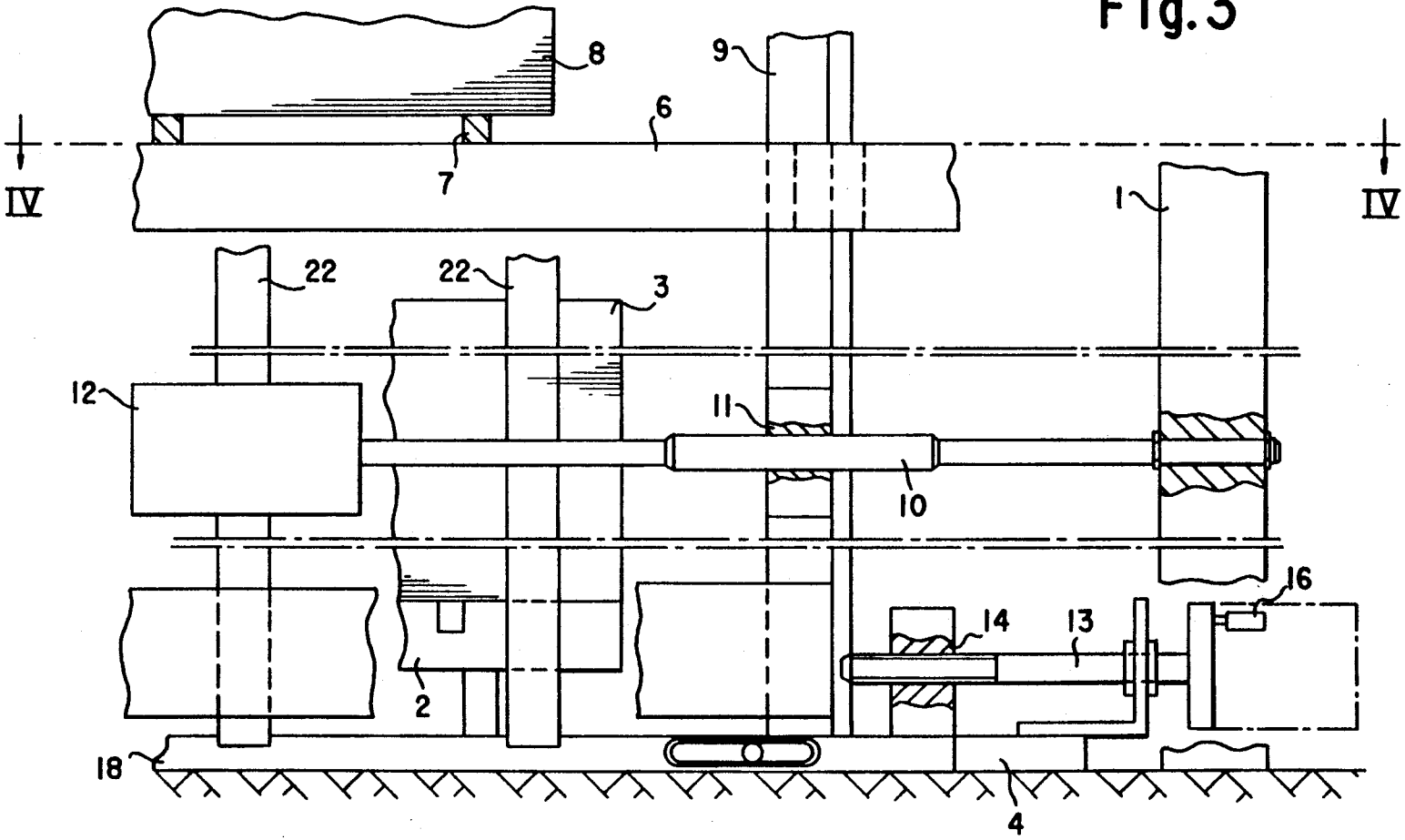
FIG. 3 is a fragmentary front elevational view similar to that of FIG. 1 of another embodiment of the adjustment device, as seen in a direction counter to the sheet transport direction.
Figure 4:
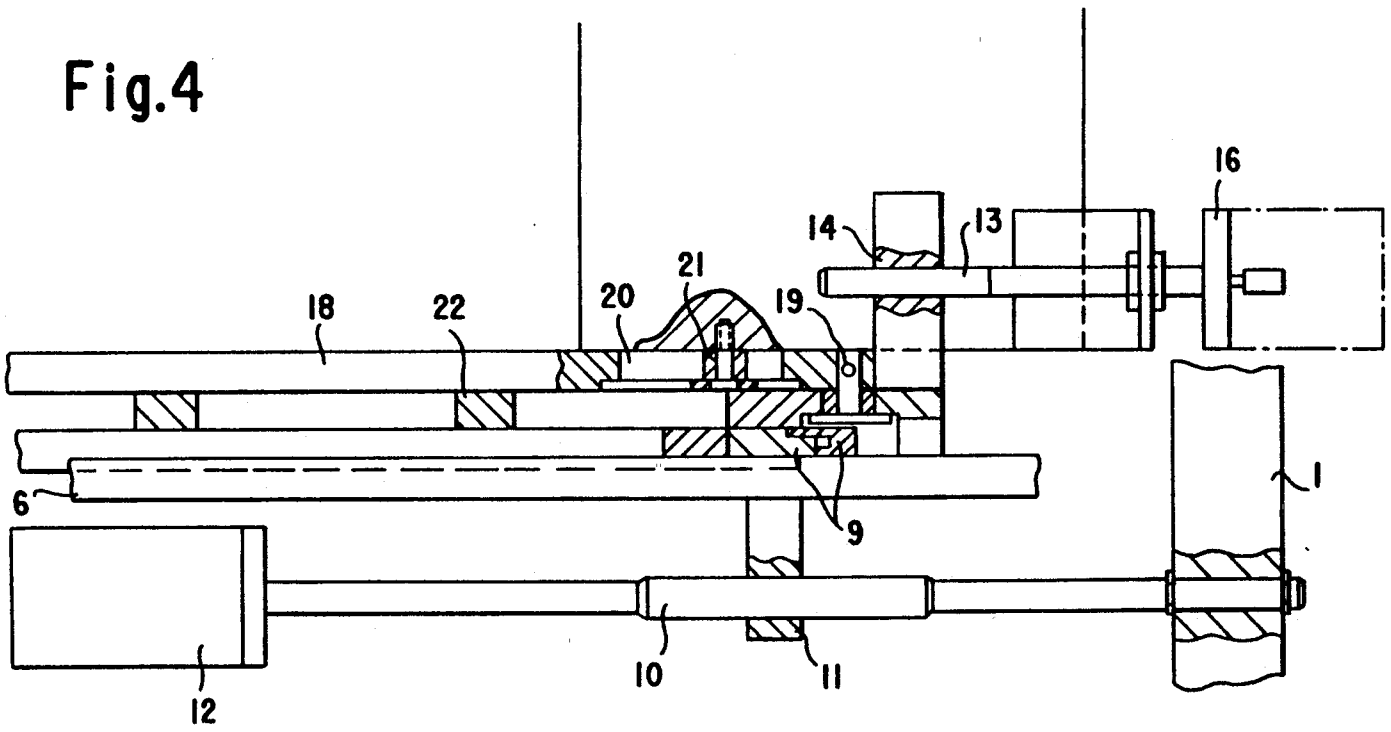
FIG. 4 is a horizontal sectional view of FIG. 3 taken along the line IV—IV in the direction of the arrows and showing the adjustment device below the auxiliary pile shown in FIG. 3.

Another and relatively simplified embodiment of the adjustment device according to the invention is illustrated in FIGS. 3 and 4. In accordance therewith, only one vertical guide 9 is provided whereon the non-stop rails 6 carrying the auxiliary pile 8 via the non-stop rods 7 as well as the pile board 4 carrying the main pile 3 on the pile table 2 are guided. A threaded spindle 10 connects the guide 9 with the side part of the machine frame 1. The threaded spindle 10 penetrates a threaded spindle nut 11 fastened to the guide 9, and is driveable by the geared motor 12 which is regulated by the non-illustrated sheet travel or feed control. A further threaded spindle 13 is rotatably mounted directly on the pile board 4 so as to be fixed against axial displacement and penetrates a threaded spindle nut 14 which is fixedly connected to the guide bar 18. The guide bar 18, in turn, is fixedly connected to parts of the guide 9, in sheet transport direction by a guide pin 19, as is described with respect to the embodiment of FIG. 2. With this arrangement, a lateral alignment movement of both the auxiliary pile 8 supported by the non-stop rails 6 as well as of the main pile 3 supported by the pile table 2 on the pile board 4 is effected via the threaded spindle 10, yet the main pile 3 is additionally alignable laterally with respect to the auxiliary pile 8 by turning the threaded spindle 13. Instead of mounting the threaded spindle 13 on the pile board 4, as illustrated in FIGS. 3 and 4, it also can be mounted directly on parts of the guide 9, so that the threaded spindle nut 14 penetrated by the threaded spindle 13 is to be fastened on the pile board 4. With this relatively simplified construction, a handwheel 16 is provided in place of a motor for operating the threaded spindle 13.

We claim:

1. In a sheet feeder, an arrangement comprising first laterally adjustable guide means for guiding a vertically displaceable pile table, second laterally adjustable guide means for guiding a vertically displaceable auxiliary-pile carrying device, and means for adjusting said first guide means and said second guide means jointly and for adjusting said first and said second guide means relative to one another in a given direction of movement for effecting a lateral alignment.

2. Sheet feeder arrangement according to claim 1, wherein said adjusting means comprise an adjusting element connecting said first and said second guide means and being operative for moving said first and said second guide means in said given direction of movement.

3. Sheet feeder arrangement according to claim 2, wherein said adjusting element includes a threaded spindle and a threaded spindle nut threadedly penetrated by said threaded spindle, said threaded spindle nut being fixed to one of said first and second guide means, and said threaded spindle being mounted on the other of said first and second guide means so as to be turnable thereon and fixed against axial movement relative thereto.

4. Sheet feeder arrangement according to claim 3, wherein said adjusting means comprise another adjusting element operative for moving said second guide means in said given direction of movement for effecting a lateral alignment and adjustably connecting said second laterally adjustable guide means to a fixed side frame part, and including a drive motor for operating said other adjusting element, said first-mentioned adjusting element adjustable connecting said second guide means to said first laterally adjustable guide means.

5. Sheet feeder arrangement according to claim 4, wherein said other adjusting element comprises a threaded spindle mounted on said side frame part so as to be rotatable thereon and fixed against axial displacement relative thereto, and a threaded nut fixed to said second laterally adjustable guide means, said threaded spindle threadedly penetrating said threaded nut.

6. Sheet feeder arrangement according to claim 2, wherein said adjusting element connecting said first and said second guide means is manually rotatable.

* * * * *